US006987494B2

(12) United States Patent
Keren

(10) Patent No.: US 6,987,494 B2
(45) Date of Patent: Jan. 17, 2006

(54) ANTENNA ASSEMBLIES FOR WIRELESS COMMUNICATION DEVICES

(75) Inventor: Hanan Keren, Kfar Sava (IL)

(73) Assignee: BroadSat Technologies Inc., Wilmington, DE (US)

( * ) Notice: Subject to any disclaimer, the term of this patent is extended or adjusted under 35 U.S.C. 154(b) by 0 days.

(21) Appl. No.: 10/802,725

(22) Filed: Mar. 18, 2004

(65) Prior Publication Data

US 2004/0174316 A1 Sep. 9, 2004

Related U.S. Application Data

(63) Continuation-in-part of application No. PCT/IL02/00934, filed on Nov. 21, 2002.

(60) Provisional application No. 60/455,441, filed on Mar. 18, 2003, provisional application No. 60/334,934, filed on Dec. 4, 2001, provisional application No. 60/331,726, filed on Nov. 21, 2001.

(51) Int. Cl.
*H01Q 1/36* (2006.01)

(52) U.S. Cl. ..... 343/895; 343/702

(58) Field of Classification Search ..... 343/742, 343/743, 867, 870, 895, 702, 767, 770
See application file for complete search history.

(56) References Cited

U.S. PATENT DOCUMENTS

| | | | | |
|---|---|---|---|---|
| 4,287,603 | A * | 9/1981 | Moser | 455/293 |
| 6,538,616 | B1 * | 3/2003 | Bedard | 343/788 |
| 6,690,336 | B1 * | 2/2004 | Leisten et al. | 343/895 |
| 6,873,302 | B1 * | 3/2005 | Welsh | 343/867 |

* cited by examiner

*Primary Examiner*—Hoang V. Nguyen

(57) ABSTRACT

An antenna assembly for a cellular telephone, includes a solid dielectric core, and a two-terminal balanced antenna assembly, including an electrical conductor on the solid dielectric core; the electrical conductor being configured and dimensioned to be matched to the operating frequency band of the cellular telephone communication band and terminating at each of its opposite ends in a common feed point connection such as to provide a two-terminal balanced antenna assembly having an isotropic radiation pattern and reduced electromagnetic field radiation. In two described embodiments, the electrical conductor is configured to define two orthogonal coils; and in a third described embodiment, it is configured to define an electrically-conductive wire extending axially through the core, and an electrically-conductive helix extending around the outer surface.

20 Claims, 3 Drawing Sheets

ANTENNA ASSEMBLIES FOR WIRELESS COMMUNICATION DEVICES

RELATED APPLICATIONS

This application is a Continuation-in-Part U.S. National Phase Application of PCT/IL02/00934, having an International Filing Date of Nov. 21, 2002, which claims priority from U.S. Provisional Patent Application Nos. 60/334,934 filed Dec. 4, 2001 and 60/331,726 filed Nov. 21, 2001, and also claims priority from U.S. Provisional Patent Application No. 60/455,441, filed Mar. 18, 2003.

FIELD AND BACKGROUND OF THE INVENTION

The present invention relates to antenna assemblies for wireless communication devices. The invention is particularly useful for cellular telephone communication devices and is, therefore, described below with respect to this application.

Great concern has been expressed that the magnetic component of the near-field radiation, which penetrates the user's head and causes thermal heating within the brain soft tissues due to induced eddy currents, could have a deleterious effect on the user, particularly over the long term. The electrical component of the near-field radiation, which does not penetrate the user's head due to skin conductivity, does not have such a deleterious effect on the user. Many techniques have been proposed to shield the user's head from the antenna, or for otherwise distancing the user's head from the antenna, since the radiation absorbed varies inversely to an inordinate degree with respect to this distance.

Moreover, the signal strength at which the cellular phone operates, and its antenna radiation pattern in space, not only affect the near-field radiation produced by the cellular phone, but also affect the usable period of the battery supply before recharging or replacement is required.

It would therefore be desirable to provide an antenna assembly which enables the cellular phone to be operated with better communication quality and less power, not only to reduce the near-field radiation produced by the cellular phone, but also to increase the usable period of the battery power supply before requiring recharging or replacement.

OBJECTS AND SUMMARY OF THE INVENTION

An object of the present invention is to provide an antenna assembly for use with wireless communication devices in general, and with cellular phones in particular, which enables the communication device to be operated with reduced near-field radiation, as well as with better communication quality and lower battery power consumption, thereby permitting longer periods of use before requiring recharging or replacement.

According to a broad aspect of the present invention, there is provided an antenna assembly for cellular telephones, comprising: a solid dielectric core, and a two-terminal balanced antenna assembly including an electrical conductor on the solid dielectric core; the electrical conductor being configured and dimensioned to be matched to the operating frequency band of the cellular telephone communication band and terminating at each of its opposite ends in a common feed point connection such as to provide a two-terminal balanced antenna assembly having an isotropic radiation pattern and reduced electromagnetic field radiation.

Since such an antenna assembly has isotropic properties, it is capable of transmitting and receiving signals in all directions. Therefore, it is less sensitive to the specific orientation of the antenna assembly and, thereby, enables the cellular phone, or other wireless communication device with which the antenna is used, to be operated with lower near-field signal strength without interruption in the transmission or reception due to the orientation of the antenna assembly at any particular time. By thus lowering the signal strength for operation of the cellular phone, the near-field radiation absorbed by the user is also reduced. In addition, the period of time during which the battery power supply can be used is increased before recharging or replacement is required.

Several embodiments of the invention are described below for purposes of example.

In two described embodiments, the electrical conductor is configured to define a first electrically-conductive loop in a first plane, and a second electrically-conductive loop in a second plane orthogonal to the first plane; the first and second electrically-conductive loops being connected in series with the common feed point connection to provide the two-terminal balanced antenna assembly.

According to further features in the latter described embodiments, the first and second electrically-conductive loops are located and electrically connected such that: one-half of the first loop is in the first plane and is connected at one end to a first feed point connection; the second loop is fully in the second plane orthogonal to the first plane and is electrically connected at one end to the opposite end of the one-half of the first loop and the remaining one-half of the first loop is in the first plane and is electrically connected between the opposite end of the second loop and a second feed point connection.

In one described preferred embodiment, each of the loops is of a length equal to one-half the wavelength of a predetermined frequency within the operating frequency band of the antenna assembly, such that the antenna assembly is of one full wavelength. In a second described embodiment, each of the loops is of a length equal to one-quarter wavelength of a predetermined frequency within the operating frequency band of the antenna assembly, such that the antenna assembly is of a one-half wavelength.

According to further features in the described preferred embodiments, each of the loops is of rectangular configuration, more particularly of square configuration, and is constituted of an electrical conductor of flat cross-section. It will be appreciated that the antenna assembly could be of other configurations (e.g., circular), and constituted of electrical conductors of other cross-sections (e.g., circular).

According to still further features in the described embodiments, the first and second loops of the antenna assembly enclose a cubical block of a solid dielectric material. The solid dielectric material is preferably one selected from the group of aluminum oxide, aluminum nitride, silicon nitride, zirconium oxide and a ferroelectrical dielectric. Particularly preferred materials are: aluminum oxide having a dielectric constant of in the range of 8.2–10.1; aluminum nitride and/or silicon nitride having a dielectric constant of about 9.9; the glass-ceramic Macor having a dielectric constant of about 5.9; Mullite having a dielectric constant of about 6.0, Zirconia having a dielectric constant in the range of 28–29, Vespel having a dielectric constant of about 13.5, and Kynar (PVDF) having a dielectric constant of about 8.0. However, other materials having similar dielectric characteristics may be used.

According to a still further described embodiment, the electrical conductor includes an electrically-conductive wire extending axially through the core, and an electrically-conductive helix extending around the outer surface of the core; one end of the electrically-conductive wire and one end of the electrically-conductive helix being electrically-connected together; the opposite ends of the electrically-conductive wire and the electrically-conductive helix constituting common feed terminals defining the common feed point connection.

While theoretically the dielectric core in this embodiment could be of cubical or other shape, best results are obtained when it is of a cylindrical configuration since such a configuration generates a more uniform electromagnetic field around the axis of the antenna assembly.

According to another aspect of the present invention, there is provided an antenna assembly for a wireless commination device, comprising: a first electrically-conductive loop constituted of two half-loops both disposed in a first plane; and a second electrically-conductive loop disposed in a second plane orthogonal to the first plane and located between the two half loops; the first and second loops being connected together in series with a common feed point.

According to a still further aspect of the present invention, there is provided a two-terminal balanced antenna assembly for a transceiver of a wireless communication device, comprising: a dielectric core; an electrically-conductive wire extending axially through the core; and an electrically-conductive helix of at least one complete helical turn extending around the outer surface of the core; one end of the electrically-conductive wire and one end of the of electrically-conductive helix being electrically-connected together; the opposite ends of the electrically-conductive wire and the electrically-conductive helix constituting common feed terminals, such as to provide a two-terminal balanced antenna assembly having reduced electromagnetic field radiation from the body of a transceiver when attached thereto in comparison to a monopole antenna of comparable gain.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and various possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF PREFERRED EMBODIMENTS

Figure 1:
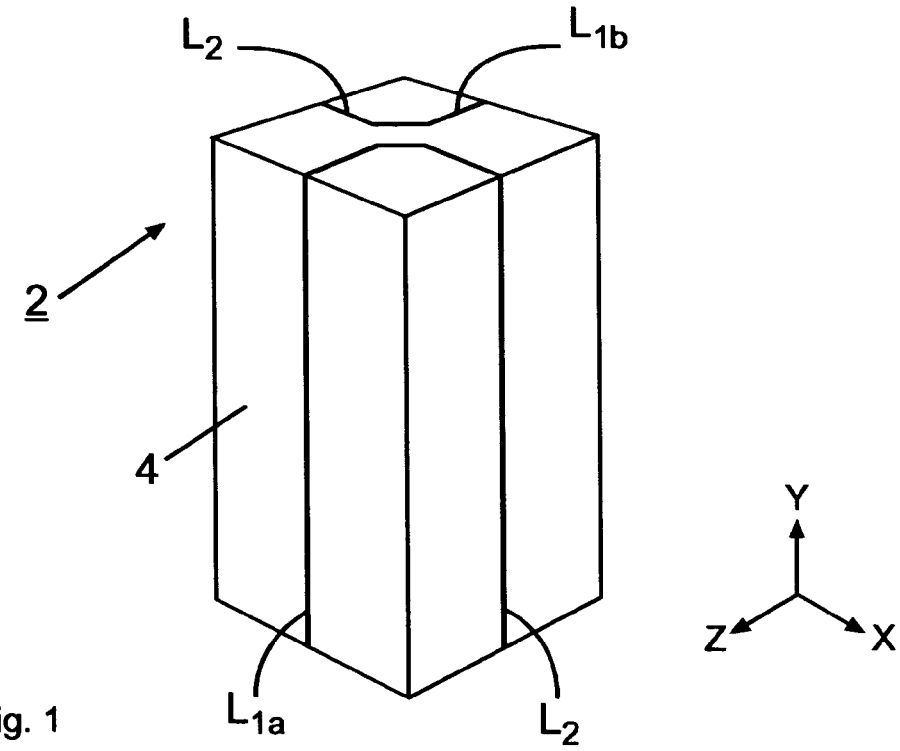
FIG. 1 is a three-dimensional view from above, illustrating one form of antenna assembly constructed in accordance with the present invention.
Figure 2:
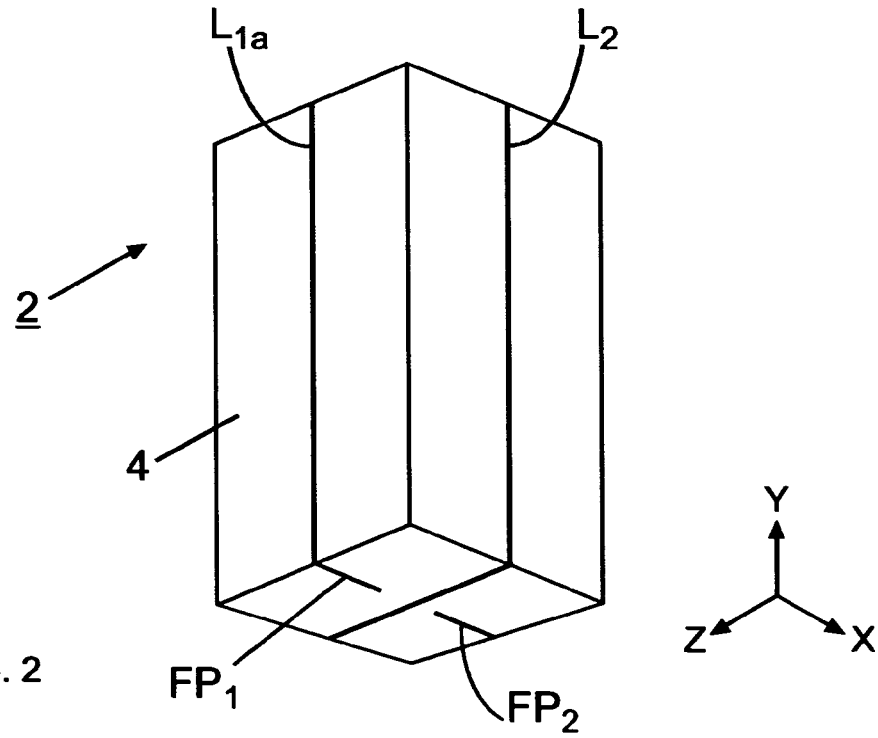
FIG. 2 is a three-dimensional view from below of the antenna assembly illustrated in FIG. 1.

Reference is first made to FIGS. 1 and 2, illustrating, from different viewing points, one form of antenna assembly constructed in accordance with the present invention. As shown in FIGS. 1 and 2, the antenna assembly, therein generally designated 2, comprises a block 4 of dielectric material for supporting a first loop in one plane, and a second loop in a second plane orthogonal to the first plane. In the example illustrated in FIGS. 1 and 2, the first loop is constituted of two half-loops $L_{1a}$, $L_{1b}$ supported in the YZ plane; whereas the second loop is constituted of a single full loop $L_2$ and is supported in the XY plane. Both loops are connected in series with a common feed point connection defined by feed points $FP_1$, $FP_2$ (FIG. 2).

More particularly, in the example illustrated in FIGS. 1 and 2, the dielectric material 4 is in the form of a hexahedron (cube). Thus, each of the half-loops $L_{1a}$, $L_{1b}$ of the first loop is of a semi-rectangle configuration; whereas the full second loop $L_2$ is of a rectangle configuration.

As will also be seen, particularly from FIG. 2, the two loops are located and electrically connected such that half-loop $L_{1a}$ is in the YZ plane and is connected at one end to feed-point connection $FP_1$; the second loop $L_2$ is fully in the XY plane and is electrically connected at one end to the opposite end of half-loop $L_{1a}$; and half-loop $L_{1b}$ is in the YZ plane and is electrically connected between the opposite end of loop $L_2$ and the second feed-point connection $FP_2$.

Preferably, each of the loops, namely the two half-loops $L_{1a}$, $L_{1b}$ taken together and the full loop $L_2$, is equal to one-half the wavelength of the predetermined frequency within the operative frequency band of the antenna assembly, such that the antenna assembly is a full wavelength antenna.

However, each of the loops may be of a length equal to one-quarter the wavelength of the predetermined frequency such that the antenna assembly would be a one-half wavelength antenna.

As shown in FIGS. 1 and 2, the electrical conductor of the two loops is of a flat cross-section and is applied over the outer surface of the cubical dielectric body 4.

Figure 3:
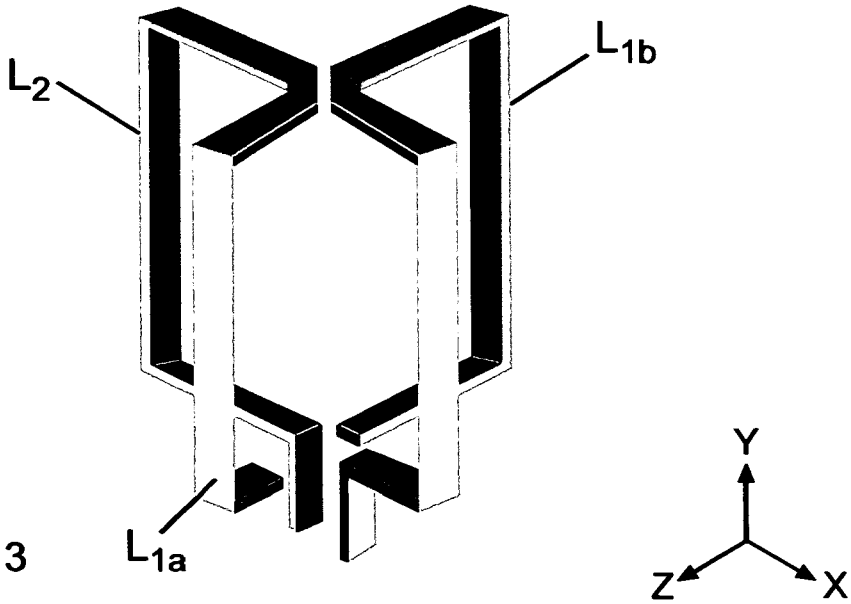
FIG. 3 illustrates a further antenna assembly constructed in accordance with the present invention.

FIG. 3 illustrates a further embodiment, wherein the two loops, ($L_{1a}$, $L_{1b}$ and $L_2$, respectively) are made of electrically-conductive strips of flat cross-section, and are embedded, or otherwise covered, by the body of dielectric material (not shown). This antenna layout includes room for a balancing capacitor to reduce the influence of user objects on the antenna characteristics.

Figure 4:
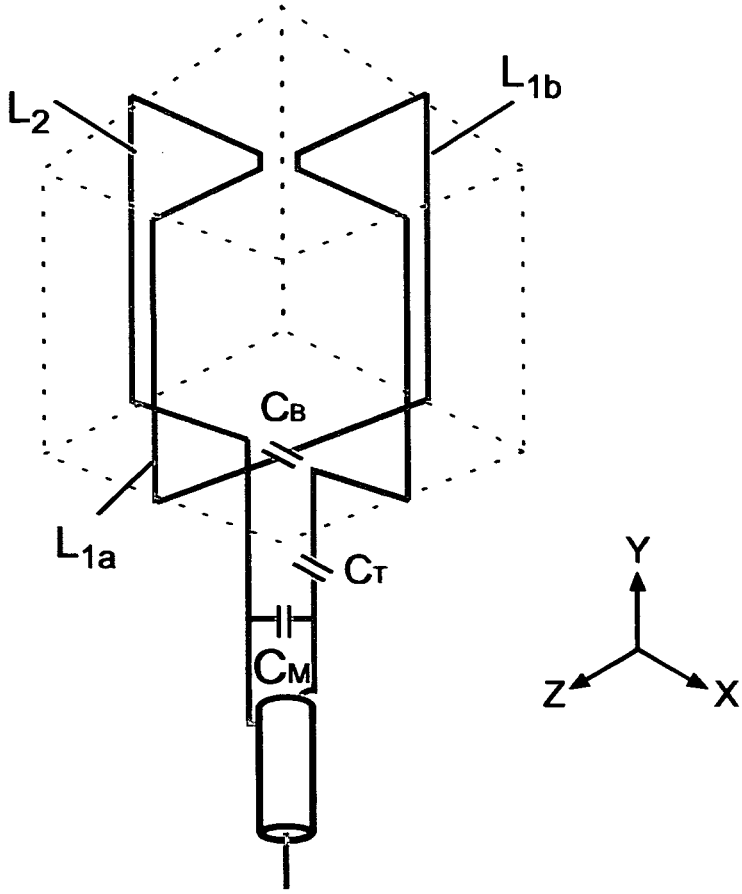
FIG. 4 is an equivalent circuit diagram illustrating one example of an electrical circuit that may be used for connecting the antenna assembly to the wireless communication equipment with which it is used.

FIG. 4 illustrates one example of an equivalent circuit that may be used for connecting the illustrated antenna assembly as described above to wireless communication equipment having a characteristic impedance of 50 ohm. The balancing capacitor $C_B$ keeps the antenna characteristics from being influenced by user objects, such as the human hand or the head. For example, $C_B$ may be in the range of about 3·5 pF. The value of the tuning capacitor $C_T$, may also be in the range of 3·5 pF, and the value the matching capacitor $C_M$ may be in the range of 3–10 pF. The value of the impedance Z in the illustrated antenna assembly of FIG. 4 may be computed as follows, in terms of the skin effect resistance together with the radiation resistance ($R_S$):

$$\frac{I}{Z} = j\omega C_M + \frac{I}{R_s + j\left(\omega L - \frac{i}{\omega C_T}\right)} \quad \text{(Eq. 1)}$$

$$= \frac{R_S}{R_S^2 + \left[\omega L - \frac{I}{\omega C_T}\right)^2} + j\left[\omega C_M - \frac{\omega L - \frac{I}{\omega C_T}}{R_S^2 + \left(\omega L - \frac{I}{\omega C_T}\right)^2}\right] \quad \text{(Eq. 2)}$$

The 50Ω Matching Boundary Conditions $$C_M = \left(\frac{1}{\omega}\right)\cdot\left(\frac{\omega L - \frac{I}{\omega C_T}}{R_S^2 + \left(\omega L - \frac{I}{\omega C_T}\right)^2}\right) \quad \text{(Eq. 3)}$$

$$= \frac{\sqrt{R_S(50 - R_S)}}{(R_S^2 + 50R_S - R_S^2)\omega}$$

$$= \frac{\sqrt{R_S(50) - R_S}}{50 \cdot R_S \cdot \omega}$$

$$\frac{I}{50} = \frac{Rs}{R_S^2 + \left(\omega L - \frac{I}{\omega C_T}\right)^2} \quad \text{(Eq. 4)}$$

$$= > \omega L - \frac{I}{\omega C_T}$$

$$= \sqrt{Rs(50 - R_S)}$$

$$Q = \frac{\omega L}{R_S} = > \frac{I}{\omega C_T} = \omega L - \sqrt{R_S(50 - R_S)} \quad \text{(Eq. 5)}$$

$$= Q \cdot R_S - \sqrt{R_S(50 - R_S)}$$

$$C_T = \frac{1}{\omega\left(QRs - \sqrt{R_S(50 - R_S)}\right)} \quad \text{(Eq. 6)}$$

In the existing standard telephone, Helix Monopole and Double Helix Dipole operating frequency:

$$f \approx C/L \quad \text{(Eq. 7)}$$

$$L = (\pi \times D \times N + H) \quad \text{(Eq. 8)}$$

Where:

f=antenna operating frequency
C=speed of light (=$3\times10^{10}$ cm/sec)
L=length of the helix antenna wire
D=helix diameter
N=number of turns
H=height of Helix
π=3.1416

Dilex operating frequency:

$$f \approx C/(L \times \sqrt{\in}) \quad \text{(Eq. 9)}$$

$$L = 4 \times (H + W) \quad \text{(Eq. 10)}$$

Figure 5:
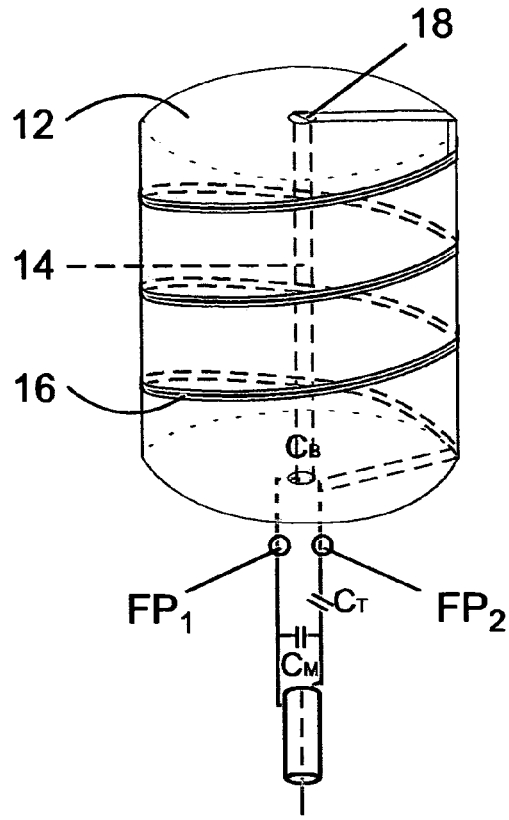
FIG. 5 illustrates another construction of antenna assembly in accordance with the present invention.

Where:

f=antenna operating frequency
C=speed of light (=$3\times10^{10}$ cm/sec)
L=length of the Dilex antenna wire
H=dielectric height
W=dielectric width
∈=dielectric constant FIG. 5 illustrates another form of two-terminal balanced antenna assembly constructed in accordance with the present invention for a transceiver of a wireless communication device. It includes a dielectric core 12 of cylindrical configuration; an electrically-conductive wire 14 extending axially through the core; and an electrically-conductive helix 16 extending around the outer surface of the core. One end of wire 14, and one end of helix 16, are electrically connected together, as shown at 18. The opposite ends of the wire 14 and the helix 16 constitute common feed terminals or feed points, as shown at $FP_1$ and at $FP_2$ respectively.

Figure 6:
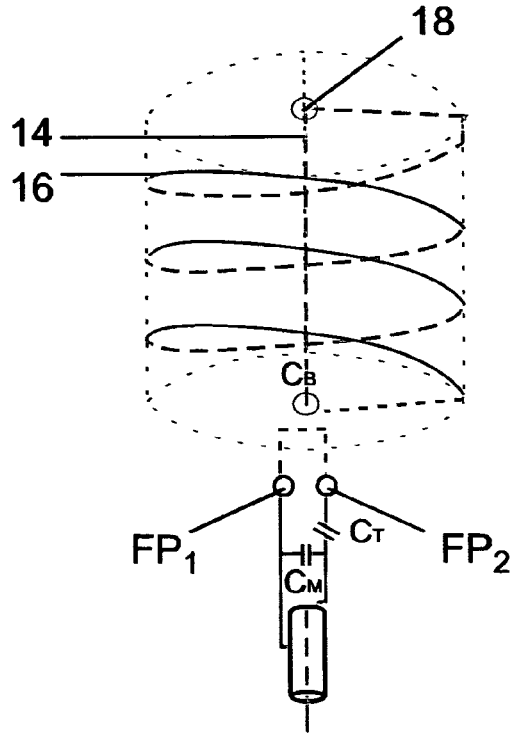
FIG. 6 illustrates the equivalent circuit when connecting the antenna assembly of FIG. 5 to a wireless communication equipment having a characteristic impedance of 50 ohm.

FIG. 6 illustrates an equivalent circuit that may be used for connecting the illustrated antenna assembly as described above to wireless communication equipment having a characteristic impedance of 50 ohm. The value of the tuning capacitor $C_T$, may be in the range of 3·5 pF, and the value the matching capacitor $C_M$ may be in the range of 3–10 pF. The value of the impedance Z in the antenna assembly illustrated in FIGS. 5 and 6 may also be computed as described above with respect to FIGS. 1–4 in terms of the skin effect resistance together with the radiation resistance ($R_S$):

The antenna assembly described herein with respect to FIGS. 5 and 6 also alleviates loop pattern directivity and provides the other advantages discussed above. Moreover the architecture of the antenna is designed in a way that assures minimal coupling and balanced RF behavior.

TECHNICAL DISCUSSION

The following discussion will be helpful in understanding the operation and advantages of the antenna assemblies described above.

Both the near-field and the far-field components of the Electro-Magnetic (EM) field of a dipole antenna much smaller than a wavelength are set forth in the following equations, as appearing on page 498 of the book "Fields and Waves in Modern Radio" by Simon Ramo and John R. Whinnery, second edition, (page 498):

$$H_\phi = \frac{I_o h}{4\pi} e^{jkr}\left[\frac{jk}{r} + \frac{1}{r^2}\right]\sin\phi \quad \text{Eq. 11}$$

$$Er = \frac{I_o h}{4\pi} e^{-jkr}\left[\frac{2\eta}{r^2} + \frac{2}{j\omega\varepsilon r^3}\right]\cos\phi$$

$$E\phi = \frac{I_o h}{4\pi} e^{-jkr}\left[\frac{j\omega\mu}{r} + \right]\frac{1}{j\omega\varepsilon r^3} + \frac{\eta}{r^2}\sin\phi$$

These equations comply with both the standard dipole antenna of the cellular handset and the antenna assemblies described above, as the dimensions of both kinds of antennas (order of 1 cm) are much smaller than the RF (Radio Frequency) wavelength of 30 cm in air at 900 MHz of the cellular frequency band. Thus, the EM fields of both dipole and loop antennas can well be approximated by vectorial summation of very small dipole elements.

The near-field magnetic component, Hϕ in the above equations is predominantly responsible for the RF power deposition in a form of thermal heating within the human brain. The physical phenomenon responsible for this brain heating is the induced eddy currents within the human brain tissue as a result of the time varying magnetic field Hϕ.

The time varying electric components in the near field, Eθ and Er, in the above equations, cause thermal heating only for the face skin as these EM components are shortened and blocked from penetrating the face skin due to the electrical conductance of the human tissues.

In regard to the far-field EM radiation pattern in both the transmit mode and the receive mode, the standard dipole antenna is of an omni-directional radiation pattern around the antenna long axis, while the loop antenna is of a more directive pattern. Thus the loop antennas will show an inferior communication performance when not directed optimally either toward the transmitting cellular base station or toward the direction where the received radiation is reflected toward the loop antenna.

Because of the directivity behavior in the loop antenna pattern, the antenna assemblies described herein with two orthogonal loops (FIGS. 1–4), and with a helical conductor joined to an axial conductor (FIGS. 5 and 6) alleviate loop pattern directivity. Moreover the architecture of the described antenna assemblies is designed in a way that assures minimal coupling and balanced RF behavior.

The dielectric material in the core of the described antenna assembly enables the antenna size to be reduced, as the minimum needed antenna conductor length for high enough antenna radiation resistance is inversely proportional to the square root of the material dielectric constant.

The average RF transmitted power is reduced significantly in these antenna patterns and thus the transmitted RF power to the human brain is also reduced indirectly on the average.

A standard cellphone helix or whip antenna essentially functions as a dipole arrangement, in which the antenna acts as one half of the dipole, and the body of the phone as the other half. In contrast the antennas described above with reference to FIGS. 1–4 and 5–6, respectively, reduces substantially the radio frequency radiation from the phone body by virtue of the balanced antenna circuit being thus isolated from the cellphone body.

The described antennas are electrically small and therefore experience a reduced radial electric field component. In comparison to a dipole or monopole type element, such as a helical whip antenna commonly used in mobile phone handsets, the described antennas produce lower radial E-fields, and consequently, lower total E-fields in the proximity of the element. The described antennas exploit the possibility of drastically reduced SAR (Specific Absorption Rate) and a longer battery lifetime for the cellular handset, in comparison to the standard monopole or dipole type antennas.

To achieve this performance, the electrical specifications for the final radio frequency stage of the cellular handset phones should match the balanced antenna design. This balanced antenna design will imply, in theory, that loading effects due to human handling are minimal. In a realistic situation, in which the user is holding the mobile handset, lower RF transmitted power is required for maintaining the cellular communication quality at the same quality of service, resulting in a longer battery lifetime for the cellular handset.

In all the tested cases for various cellphone manufacturers, all using the standard antenna, it was found that the peak SAR from mobile phone handsets occurs adjacent to the body of the mobile phone. In all of these instances, the antennas described above offer the potential to reduce such radiation and therefore to lower the peak SAR.

The described antenna designs could be optimized for reduction of the SAR to the human brain from the cellphone body ($W_{Body}$) by a factor of 10 relative to the performance of existing cellular handsets, as follows: In the case of an unbalanced standard antenna design, where the antenna acts as one-half of the dipole and the body of the phone as the other half, the running current in the antenna ($I_{Std\ Ant}$) is equal to the running current in the cellphone body ($I_{Body}$). In the case of the above-described balanced antennas, where the cellphone body is isolated from the antenna circuit, the running current in the antenna ($I_{new\ Ant}$) is higher by the square-root of the quality factor (Q) of the antenna circuit than the running current in the cellphone body ($I_{Body}$).

Since that the SAR from the cellphone antenna ($A_{Antenna}$) and from the cellphone body ($W_{Body}$) is proportional to the square of the current, the reduction in the SAR with the new antenna is obtained from the maximum possible Q factor for cellular antenna circuit needed to support up to 10% bandwidth ($\Delta\omega$) around the mid-band frequency ($\omega_0$), as derived from the following equations:

$$\omega_0/\Delta\omega=10$$

$$Q=\omega_0/\Delta\omega$$

$$(W_{Antenna}/W_{Body})_{New\ Ant}=Q=10 \qquad {}_{Ant}/(W_{Antenna}/W_{Body})_{Std}$$

An additional benefit, when radiation occurs predominantly from the antenna circuit as with the new antennas, rather than the mobile handset body, is that loading effects due to handling are minimal. This gives the potential for improved antenna gain, in a realistic situation in which the user is holding the mobile handset. Thus lower RF transmitted power is required for maintaining the cellular communication quality at the same grade of service, resulting in a longer battery lifetime for the cellular handset.

The dielectric material in the core enables the antenna size to be reduced, as the minimum needed antenna conductor length for high enough antenna radiation resistance is inversely proportional to the square root of the material dielectric constant.

The average RF transmitted power is also reduced significantly in this antenna pattern and thus the transmitted RF power to the human brain is also reduced indirectly on the average.

While the present invention has been described with respect to several preferred embodiments, it will be appreciated that these are set forth merely for purposes of example, and that many other variations and applications of the invention may be made.

What is claimed is:

1. An antenna assembly for a cellular telephone, comprising: a solid dielectric core, and a two-terminal balanced antenna assembly including an electrical conductor on said solid dielectric core; said electrical conductor being configured and dimensioned to be matched to the operating frequency band of the cellular telephone communication band and terminating at each of its opposite ends in a common feed point connection such as to provide a two-terminal balanced antenna assembly having an isotropic radiation pattern and reduced electromagnetic field radiation.

2. The antenna assembly according to claim 1, wherein said electrical conductor is configured to define a first electrically-conductive loop in a first plane, and a second electrically-conductive loop in a second plane orthogonal to said first plane; said first and second electrically-conductive loops being connected in series with said common feed point connection to provide said two-terminal balanced antenna assembly.

3. The antenna assembly according to claim 2, wherein said first and second electrically-conductive loops are located and electrically connected such that: one-half of said first loop is in said first plane and is connected at one end to a first feed point connection; said second loop is fully in said second plane orthogonal to said first plane and is electrically connected at one end to the opposite end of said one-half of the first loop; and the remaining one-half of said first loop is in said first plane and is electrically connected between the opposite end of said second loop and a second feed point connection.

4. The antenna assembly according to claim 2, wherein each of said loops is of a length equal to one-half the wavelength of a predetermined frequency within the operative frequency band of the antenna assembly, such that the antenna assembly is of one full wavelength.

5. The antenna assembly according to claim 2, wherein each of said loops is of a length equal to one-quarter wavelength of a predetermined frequency within the operative frequency band of the antenna assembly, such that the antenna assembly is of a one-half wavelength.

6. The antenna assembly according to claim 2, wherein each of said loops is of rectangular configuration.

7. The antenna assembly according to claim 2, wherein each of said loops is of square configuration.

8. The antenna assembly according to claim 1, wherein said electrical conductor is of flat cross-section.

9. The antenna assembly according to claim 1, wherein said electrical conductor includes an electrically-conductive wire extending axially through said core, and an electrically-conductive helix extending around the outer surface of said core; one end of said electrically-conductive wire and one end of said electrically-conductive helix being electrically-connected together; the opposite ends of said electrically-conductive wire and said electrically-conductive helix constituting common feed terminals defining said common feed point connection.

10. The antenna assembly according to claim 9, wherein said dielectric core is of a cylindrical configuration.

11. The antenna assembly according to claim 1, wherein said solid dielectric core is a material selected from the group of aluminum oxide, aluminum nitride, silicon nitride, zirconium oxide, and a ferroelectric dielectric.

12. A two-terminal balanced antenna assembly for a transceiver of a wireless communication device, comprising: a first electrically-conductive loop in a first plane; a second electrically-conductive loop in a second plane orthogonal to said first plane; and a solid dielectric core; said first and second electrically-conductive loops being connected in series with a common feed point connection, to provide a two-terminal balanced antenna assembly having reduced electromagnetic field radiation from the body of a transceiver when attached thereto in comparison to a monopole antenna of comparable gain.

13. The antenna assembly according to claim 12, wherein said first and second electrically-conductive loops are located and electrically connected such that: one-half of said first loop is in said first plane and is connected at one end to a first feed point connection; said second loop is fully in said second plane orthogonal to said first plane and is electrically connected at one end to the opposite end of said one-half of the first loop; and the remaining one-half of said first loop is in said first plane and is electrically-connected between the opposite end of said second loop and a second feed point connection.

14. An antenna assembly for a wireless communication device, comprising: a first electrically-conductive loop constituted of two half-loops both disposed in a first plane; and a second electrically-conductive loop disposed in a second plane orthogonal to said first plane and located between said two half loops; said first and second loops being connected together in series with a common feed point.

15. The antenna assembly according to claim 14, wherein: one-half of said first loop is in said first plane and is connected at one end to a first feed point connection; said second loop is fully in said second plane orthogonal to said first plane and is electrically connected at one end to the opposite end of said one half-loop; and the other one-half of said first loop is in said first plane and is electrically-connected between the opposite end of said second loop and a second feed point connection.

16. The antenna assembly according to claim 14, wherein said first and second loops enclose a block of a solid dielectric material.

17. The antenna assembly according to claim 14, wherein each of said loops is of rectangular configuration.

18. A two-terminal balanced antenna assembly for a transceiver of a wireless communication device, comprising: a dielectric core; an electrically-conductive wire extending axially through said core; and an electrically-conductive helix extending of at least one complete helical turn around the outer surface of said core; one end of said electrically-conductive wire and one end of said of electrically-conductive helix being electrically-connected together; the opposite ends of said electrically-conductive wire and said electrically-conductive helix constituting common feed terminals, such as to provide a two-terminal balanced antenna assembly having reduced electromagnetic field radiation from the body of a transceiver when attached thereto in comparison to a monopole antenna of comparable gain.

19. The antenna assembly according to claim 18, wherein said dielectric core is of a cylindrical configuration.

20. The antenna assembly according to claim 18, wherein the dielectric material of said dielectric core is selected from the group of aluminum oxide, aluminum nitride, silicon nitride, zirconium oxide, and a ferroelectric dielectric.

* * * * *